US010460658B2

(12) United States Patent
Xiang et al.

(10) Patent No.: US 10,460,658 B2
(45) Date of Patent: Oct. 29, 2019

(54) ORGANIC LIGHT-EMITTING DISPLAY PANEL AND DRIVING METHOD THEREOF, AND ORGANIC LIGHT-EMITTING DISPLAY DEVICE

(71) Applicant: Shanghai Tianma AM-OLED Co., Ltd., Shanghai (CN)

(72) Inventors: Dongxu Xiang, Shanghai (CN); Yue Li, Shanghai (CN); Dong Qian, Shanghai (CN); Zeyuan Chen, Shanghai (CN); Gang Liu, Shanghai (CN); Renyuan Zhu, Shanghai (CN); Tong Wu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 187 days.

(21) Appl. No.: 15/488,962

(22) Filed: Apr. 17, 2017

(65) Prior Publication Data

US 2017/0221419 A1 Aug. 3, 2017

(30) Foreign Application Priority Data

Jan. 5, 2017 (CN) ..... 2017 1 0007088

(51) Int. Cl.
*G09G 3/3233* (2016.01)

(52) U.S. Cl.
CPC ... *G09G 3/3233* (2013.01); *G09G 2300/0861* (2013.01); *G09G 2310/0251* (2013.01); *G09G 2310/0262* (2013.01); *G09G 2320/043* (2013.01)

(58) Field of Classification Search
CPC ... G09G 3/3233; G09G 3/3283; G06F 3/0412
See application file for complete search history.

(56) References Cited

U.S. PATENT DOCUMENTS

| | | | |
|---|---|---|---|
| 9,035,976 B2 | 5/2015 | Lee et al. | |
| 2007/0126460 A1 | 6/2007 | Chung et al. | |
| 2016/0224157 A1* | 8/2016 | Yang | G09G 3/3233 |

FOREIGN PATENT DOCUMENTS

| | | |
|---|---|---|
| CN | 1845229 A | 10/2006 |
| CN | 103236236 A | 8/2013 |
| CN | 103700345 A | 4/2014 |
| CN | 104050917 A | 9/2014 |

(Continued)

*Primary Examiner* — Sepehr Azari
(74) *Attorney, Agent, or Firm* — Anova Law Group PLLC

(57) ABSTRACT

An organic light-emitting display panel, a driving method and an organic light-emitting display device are provided. The organic light-emitting display panel includes a first pixel driving circuit, and a second pixel driving circuit disposed adjacent to the first pixel driving circuit along a row direction of a pixel matrix. The first pixel driving circuit is connected to a first scanning signal line, and the second pixel driving circuit is connected to a second scanning signal line. The first and the second pixel driving circuits share a same data line. The same data line is configured to time-sharingly provide an initialization signal to the first and the second pixel driving circuits, time-sharingly detect threshold voltages of driving transistors in the first and the second pixel driving circuits, and time-sharingly provide a compensated data signal to the first and the second pixel driving circuits.

16 Claims, 8 Drawing Sheets

(56) References Cited

FOREIGN PATENT DOCUMENTS

| | | | |
|---|---|---|---|
| CN | 106023900 | A | 10/2016 |
| CN | 106157895 | A | 11/2016 |
| KR | 20060024963 | A | 3/2006 |

* cited by examiner

ORGANIC LIGHT-EMITTING DISPLAY PANEL AND DRIVING METHOD THEREOF, AND ORGANIC LIGHT-EMITTING DISPLAY DEVICE

CROSS-REFERENCES TO RELATED APPLICATIONS

This application claims priority of Chinese Patent Application No. 201710007088.3, filed on Jan. 5, 2017, the entire contents of which are hereby incorporated by reference.

FIELD OF THE DISCLOSURE

The present disclosure generally relates to the field of display technology and, more particularly, relates to an organic light-emitting display panel and driving method thereof, and an organic light-emitting display device.

BACKGROUND

An organic light-emitting display utilizes the self-illuminating feature of organic semiconductor materials for display, and has advantages such as high contrast, low power consumption, etc. Often, a pixel array comprising a plurality of sub-pixels is disposed in the display region of the organic light-emitting display. Each sub-pixel includes an organic light-emitting diode and a driving transistor that drives the organic light-emitting diode to emit light.

The light-emitting current of the organic light-emitting diode is related to the voltage difference Legs between the gate electrode and the source electrode of the driving transistor, and is related to the threshold voltage Vth of the driving transistor. However, the threshold voltage Vth of the driving transistor may drift (i.e., "threshold drift") due to reasons regarding the fabrication process, and aging after long-time use, etc. Accordingly, the light-emitting brightness of the organic light-emitting device may be unstable.

To compensate the threshold voltage of the driving transistor, one existing type of organic light-emitting display panels may write an initialization signal into the gate electrode and the source electrode of the driving transistor via the reference voltage signal line and the date line. Further, the reference voltage signal line is utilized to collect the threshold voltage of the driving transistor. After an external compensating circuit is applied to compensate the threshold voltage of the driving transistor, a driving signal configured to control the light-emitting brightness of the organic light-emitting diode is written into the driving transistor again via the reference voltage signal line and data line.

According to the present disclosure, in such organic light-emitting display panel, the reference voltage signal line is not only configured to provide the initialization signal and the driving signal, but also configured to collect the threshold voltage. Thus, the working status of the reference voltage signal line may be unstable. Further, to save the wiring number and space, a plurality of sub-pixels may utilize the same reference voltage signal line for signal write-in and threshold voltage collection. Accordingly, the working status of each reference voltage signal line in a period of displaying one frame image may need to be switched a couple of times, which increases the load of the driving chip configured to control the reference voltage signal line.

In addition, a plurality of sub-pixels connected to the same reference voltage signal line are located at different positions, and the threshold voltages of the driving transistors at different locations fed back to the driving chip by the reference voltage signal line may have a certain voltage drop. During compensation, the compensated data signal is inputted via the data line. For the same sub-pixel, the variance in the voltage of the data signal transmitted by the data line, is different from the variance in the threshold voltage collected and transmitted to the driving chip by the reference voltage signal line, such that accuracy and balance of the display brightness of each sub-pixel can hardly be ensured.

The disclosed organic light-emitting display panel and driving method thereof. and organic light-emitting display device are directed to solving at least partial problems set forth above and other problems.

BRIEF SUMMARY OF THE DISCLOSURE

One aspect of the present disclosure provides an organic light-emitting display panel. The organic light-emitting display panel comprises a pixel matrix including a plurality of pixel driving circuits. The plurality of pixel driving circuits includes a first pixel driving circuit, and a second pixel driving circuit disposed adjacent to the first pixel driving circuit along a row direction of the pixel matrix. The plurality of pixel driving circuits further includes a plurality of reference voltage signal lines for providing a reference voltage signal, a plurality of data lines, a plurality of light-emitting signal lines, and a plurality of scanning signal lines including a first and a second scanning signal line. A pixel driving circuit includes a driving transistor and is connected to a reference voltage signal line, a data line, a light-emitting signal line, and a scanning signal line. The first pixel driving circuit is connected to the first scanning signal line, and the second pixel driving circuit is connected to the second scanning signal line. The first and the second pixel driving circuits share a same data line that is configured to time-sharingly provide an initialization signal to the first and the second pixel driving circuits, time-sharingly detect threshold voltages of driving transistors in the first and the second pixel driving circuits, and time-sharingly provide a compensated data signal to the first and the second pixel driving circuits.

Another aspect of the present disclosure provides a driving method of an organic light-emitting display panel including a first pixel driving circuit and a second pixel driving circuit. The first and the second pixel driving circuits are connected to a same data line, a same light-emitting signal line, and a same first voltage signal line. The first pixel driving circuit is connected to a first scanning signal line and a first reference voltage signal line, and the second pixel driving circuit is connected to a second scanning signal line and a second reference voltage signal line. The driving method comprises: in a first stage, supplying a first voltage level signal to the first scanning signal line and the light-emitting signal line, supplying a second voltage level signal to the second scanning signal line, supplying a reference voltage signal to the first reference voltage signal line, and supplying a first initialization signal to the data line. Further, in the first pixel driving circuit, the first voltage signal line is configured to charge a first electrode of a driving transistor and the data line is configured to detect a voltage of the first electrode of the driving transistor, thereby determining a threshold voltage of the driving transistor in the first pixel driving circuit.

Another aspect of the present disclosure provides a driving method of an organic light-emitting display panel including a first pixel driving circuit and a second pixel driving circuit. The first and the second pixel driving circuits are connected to a same data line, a same light-emitting signal line, and a same first voltage signal line. The first pixel driving circuit is connected to a first scanning signal line and a first reference voltage signal line, and the second pixel driving circuit is connected to a second scanning signal line and a second reference voltage signal line. The driving method comprises: in the first collection stage, supplying a first voltage level signal to the first scanning signal line and the light-emitting signal line, supplying a second voltage level signal to the second scanning signal line, supplying a first initialization signal to the data line, and supplying a reference voltage signal to the first reference voltage signal line, wherein in the first pixel driving circuit, the first voltage signal line is configured to charge a first electrode of a driving transistor and the data line is configured to collect a voltage of the first electrode of the driving transistor, thereby determining and storing a threshold voltage of the driving transistor in the first pixel driving circuit in a memory.

Other aspects of the present disclosure can be understood by those skilled in the art in light of the description, the claims, and the drawings of the present disclosure.

BRIEF DESCRIPTION OF THE DRAWINGS

Other features, goals, and advantages of the present disclosure will become more apparent via a reading of detailed descriptions of non-limiting embodiments with reference to the accompanying drawings.

DETAILED DESCRIPTION

Reference will be made in detail with reference to embodiments of the present disclosure as illustrated in the accompanying drawings and embodiments. It should be understood that, specific embodiments described herein are only for illustrative purposes, and are not intended to limit the scope of the present disclosure. In addition, for ease of description, accompanying drawings only illustrate a part of, but not entire structure related to the present disclosure.

It should be noted that, when there is no conflict, disclosed embodiments and features of the disclosed embodiments may be combined with each other. Hereinafter, the present disclosure is illustrated in detail with reference to embodiments thereof as illustrated the accompanying drawings.

Figure 1:
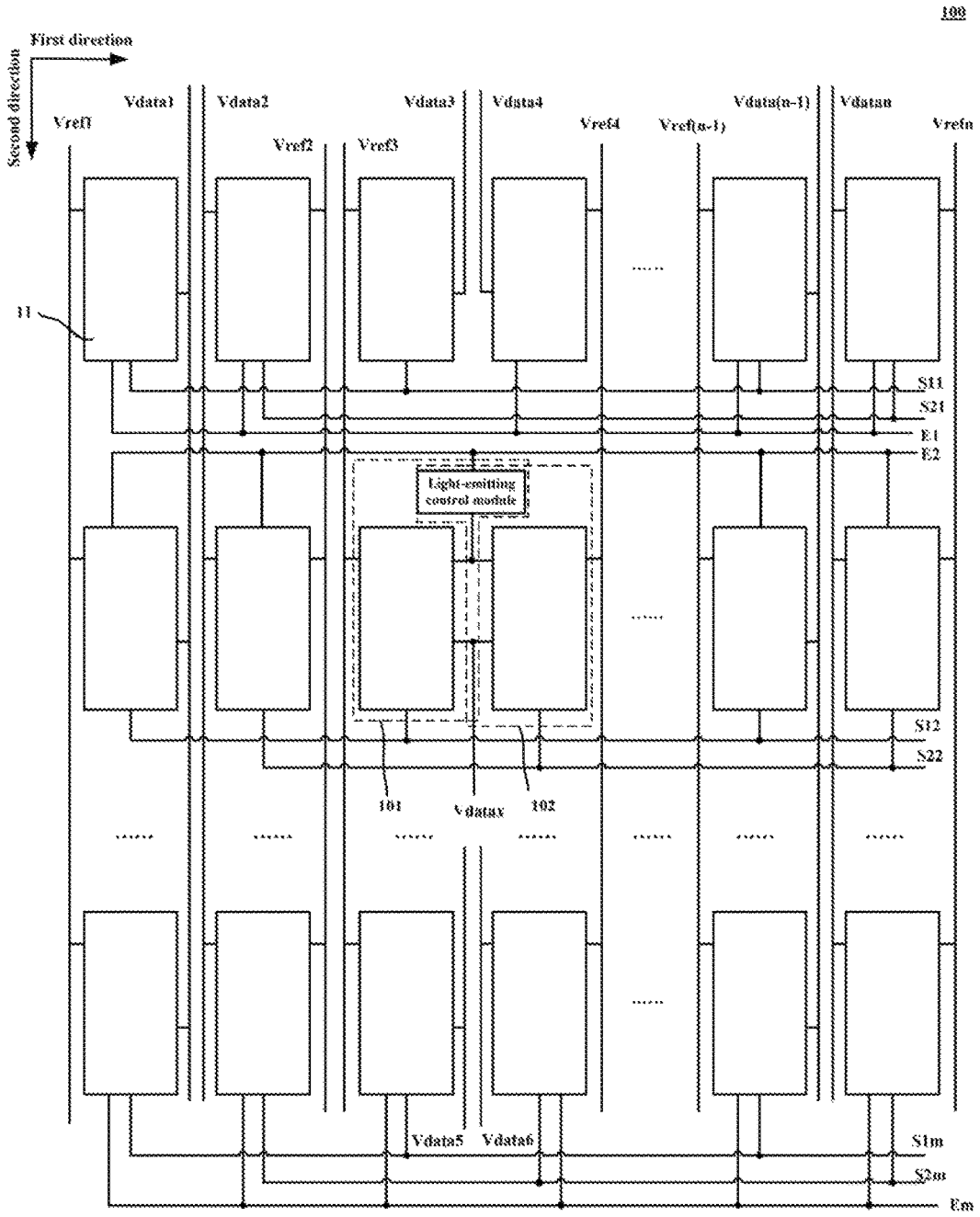
FIG. 1 illustrates a structural schematic view of an exemplary organic light-emitting display panel according to embodiments of the present disclosure.

FIG. 1 illustrates a structural schematic view of an exemplary organic light-emitting display panel 100 according to embodiments of the present disclosure. As shown in FIG. 1, the organic light-emitting display panel 100 may include a plurality of pixel driving circuits 11 arranged in a matrix. For example, each pixel driving circuit 11 may include an organic light-emitting diode, a driving transistor configured to provide a light-emitting current to the organic light-emitting diode, and a light-emitting control module configured to charge the driving transistor.

The organic light-emitting display panel 100 may further include a plurality of reference voltage signal lines Vref1, Vref2, Vref3, Vref4, . . . , Vref(n−1), Vrefn, and a plurality of data lines Vdata1, Vdata2, Vdata3, Vdata4, Vdatax, . . . , Vdata(n−1), Vdatan, where n is a positive integer greater than 1. The organic light-emitting display panel may further include a plurality of light-emitting signal lines E1, E2, . . . , Em, a plurality of first scanning signal lines S11, S12, . . . , S1*m*, and a plurality of second scanning signal lines S21, S22, . . . , S2*m*, where to is a positive integer.

In one embodiment, as shown in FIG. 1, the plurality of reference voltage signal lines may be arranged along a first direction and extending along a second direction. The plurality of data lines may be arranged along the first direction and extending along the second direction. Further, the plurality of light-emitting signal lines may be arranged along the second direction and extending along the first direction. The plurality of first scanning signal lines may be arranged along the second direction and extending along the first direction. The plurality of second scanning signal lines may be arranged along the second direction and extending along the fast direction.

Further, the plurality of reference voltage signal lines may be configured to provide a reference voltage signal to each pixel driving circuit 11. Each pixel driving circuit 11 may be connected to one reference voltage signal line. The plurality of light-emitting signal lines may be configured to provide a light-emitting control signal to each light-emitting module. Each pixel driving circuit 11 may be connected to one light-emitting signal line. Further, each pixel driving circuit 11 may be connected to one data line, and a first scanning signal line or a second scanning signal line.

As shown in FIG. 1, the plurality of pixel driving circuit 11 may include a first pixel driving circuit 101 and a second pixel driving circuit 102. The first pixel driving circuit 101 may be disposed adjacent to the second pixel driving circuit 102 along a row direction of the pixel matrix (i.e., the first direction shown in FIG. 1). Further, the first pixel driving circuit 101 and the second pixel driving circuit 102 may be connected to the same data line Vdatax. The first pixel driving circuit 101 and the second pixel driving circuit 102 may share one light-emitting control module.

In one embodiment, the data line Vdatax connected to the first pixel driving circuit 101 and the second pixel driving circuit 102 may be configured to time-sharingly (e.g., multiplexed in time) provide an initialization signal to the first pixel driving circuit 101 and the second pixel driving circuit 102. The data line Vdatax may be configured to time-sharingly detect the threshold voltage of the driving transistor in the first pixel driving circuit 101 and the threshold of the driving transistor in the second pixel driving circuit 102. Further, the data line Vdatax may time-sharingly provide a compensated data signal to the first pixel driving circuit 101 and the second pixel driving circuit 102.

In other words, within a period of time that one row of pixels is scanned, the working status of the data line Vdatax may include providing an initialization signal to the first pixel driving circuit 101, collecting the threshold voltage of the driving transistor in the first pixel driving circuit 101, and providing a data signal after the threshold voltage is compensated to the first pixel driving circuit 101. Further, within the same period of time, the working status of the data line Vdatax may further include providing an initialization signal to the second pixel driving circuit 102, collecting the threshold voltage of the driving transistor in the second pixel driving circuit 102, and providing a data signal after the threshold voltage is compensated to the second pixel driving circuit 102.

By using the disclosed organic light-emitting display panel, the first pixel driving circuit 101 and the second pixel driving circuit 102 may share one light-emitting control module and one data line (e.g., Vdatax). Accordingly, the average area of the space occupied by each pixel driving circuit may be effectively reduced and the wiring number of the data lines may be reduced, thus facilitating the design of a high-resolution display panel.

In the aforementioned organic light-emitting display panel, the data line may be configured to detect and collect the threshold voltage. That is, the data line may be configured to receive a signal including the threshold voltage. Accordingly, the reference voltage signal line may no longer need to switch working status, and transmit a constant voltage signal. Thus, losses resulted by the reference voltage signal line switching the working status may be reduced, and the driving load induced by status switching of the reference voltage signal line may be lowered.

Further, when one reference voltage signal line is connected to a plurality of pixel driving circuits, because the reference voltage signal line transmits a constant voltage signal, the plurality of pixel driving circuits at different positions may have sufficient time to be charged to reach the voltage level of the constant voltage signal. Accordingly, issues of display unevenness caused by variance in the signal-receiving time of the pixel driving circuits at different positions may be avoided.

Further, the voltage drops of the signals transmitted by the data line when collecting the threshold voltage and inputting the compensated signal may be consistent. Accordingly, different degrees of impact on the threshold voltage collection and the compensated signal input due to the difference between the data line and the reference voltage signal line may be avoided, such that the evenness of the display brightness may be improved.

Figure 2:
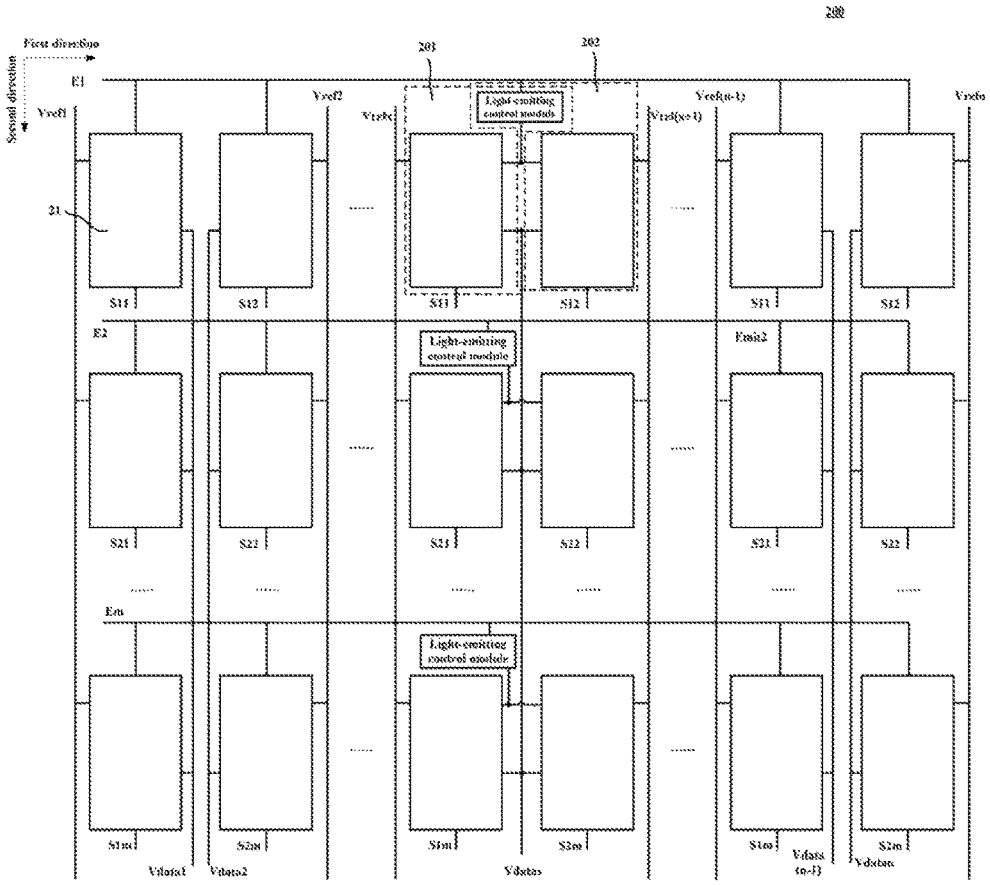
FIG. 2 illustrates a structural schematic view of another exemplary organic light-emitting display panel according to embodiments of the present disclosure.

FIG. 2 illustrates a structural schematic view of another exemplary organic light-emitting display panel 200 according to embodiments of the present disclosure. As shown in FIG. 2, the organic light-emitting display panel 200 may include a pixel matrix, a plurality of reference voltage signal lines Vref1, Vref2, . . . , Vref(n−1), Vrefn, and a plurality of data lines Vdata1, Vdata2, . . . , Vdata(n−1), Vdatan, Vdatax, where n is a positive integer greater than 1. The organic light-emitting display panel may further include a plurality of light-emitting signal lines E1, E2, . . . , Em, a plurality of first scanning signal lines S11, S12, . . . , S1*m*, and a plurality of second scanning signal lines S21, S22, . . . , S2*m*, where m is a positive integer.

The pixel matrix may include a plurality of pixel driving circuits 21 arranged in matrix, and each pixel driving circuit 21 may include an organic light-emitting control module, a driving transistor, and an organic light-emitting diode. The driving transistor may be configured to provide a light-emitting current to the organic light-emitting diode under control of the light-emitting control module.

The plurality of pixel driving circuits 21 in the pixel matrix n ay include a plurality of first pixel driving circuits 201 and a plurality of second pixel driving circuits 202. A first pixel driving circuit 201 may be disposed adjacent to a second pixel driving circuit 202 along the row direction (i.e., the first direction) of the pixel matrix. The first pixel driving circuit 201 and the second pixel driving circuit 202 may share one light-emitting control module, and may be connected to a same data line Vdatax.

In one embodiment, the plurality of first pixel driving circuits 201 may be disposed in the same column of the pixel matrix, and the plurality of second pixel driving circuits 202 may be disposed in another same column of the pixel matrix. Further, any one of the plurality of first pixel driving circuits 201 may be disposed adjacent to one of the plurality of second pixel driving circuits 202 in the row direction of the pixel matrix.

Each first pixel driving circuit 201 may share one data line with a corresponding second pixel driving circuit 202 disposed in the same row, and when display, pixel driving circuits in different rows may often be scanned time-sharingly. Thus, the plurality of first pixel driving circuits 201 and the plurality of second pixel driving circuits 202 may share the same data line Vdatax.

Further, one column of pixel driving circuits in the organic light-emitting display panel 200 may be all first pixel driving circuits 201, and a column of pixel driving circuits adjacent to the one column of pixel driving circuits may be all second pixel driving circuits 202. Accordingly, based on the organic light-emitting display panel 100, the disclosed organic light-emitting display panels may further reduce the average area of the space occupied by each pixel driving circuit and further reduce the number of the data lines. Thus the resolution may be further improved.

Optionally, for the organic light-emitting display panel illustrated in FIG. 2, the pixel driving circuits in the same column may be electrically connected to the same data line, thereby further reducing the number of data lines and improving the resolution of the organic light-emitting display panels.

Figure 3:
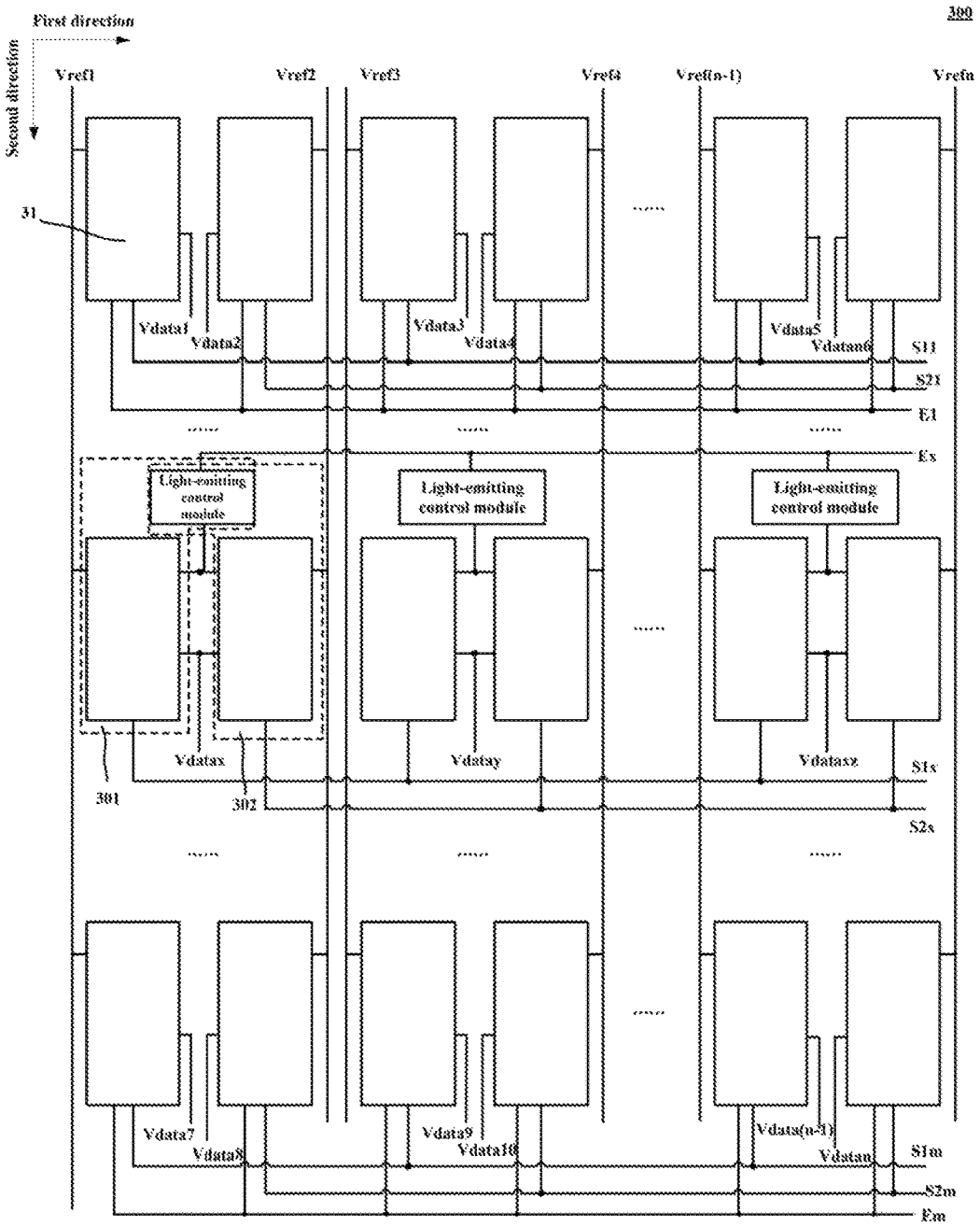
FIG. 3 illustrates a structural schematic view of another exemplary organic light-emitting display panel according to embodiments of the present disclosure.

FIG. 3 illustrates a structural schematic view of another exemplary organic light-emitting display panel 300 according to embodiments of the present disclosure. In particular, FIG. 3 illustrates one row of pixel driving circuits in the organic light-emitting display panel 300 in detail for illustrative purposes.

In one embodiment, as shown in FIG. 3, similar to the organic light-emitting display panels 100 and 200, the organic light-emitting display panel 300 may include a pixel matrix (FIG. 3 only illustrates one row of the pixel matrix in detail), and a plurality of reference voltage signal lines Vref1, Vref2, Vref3, Vref4, . . . , Vref(n−1), Vrefn, where n is a positive integer greater than 1. The organic light-emitting display panel 300 may further include a plurality of data lines Vdata1, Vdata2, . . . , Vdatan, Vdatax, Vdatay, . . . , and Vdataz.

Further, the organic light-emitting display panel 300 may include a plurality of light-emitting signal lines E1, E2 . . . , and Em. The organic light-emitting display panel 300 may further include a plurality of first scanning signal lines S11, S12, . . . , S1*m*, and a plurality of second scanning signal lines S21, S22, . . . , S2*m*, where m is a positive integer.

As shown in FIG. 3, the pixel matrix may include a plurality of pixel driving circuits 31. The plurality of pixel driving circuits 31 may include a plurality of first pixel driving circuits 301 and a plurality of second pixel driving circuits 302. The plurality of first pixel driving circuits 301 and the plurality of second pixel driving circuits 302 may be disposed in the same row of the pixel matrix. Further, the plurality of first pixel driving circuits 301 and the plurality of second pixel driving circuits 302 may be arranged alternately along the row direction of the pixel matrix (i.e., the first direction illustrated in FIG. 3).

A first pixel driving circuit 301 and a second pixel driving circuit 302 may share one light-emitting control module. Further, a first pixel driving circuit 301 and a second pixel driving circuit 302 adjacent to the first pixel driving circuit 301 may share one data line Vdatax, Vdatay, . . . , or Vdataz.

Further, in a row of pixel driving circuits 31, any pixel driving circuit 31 may be a first pixel driving circuit 301 or a second pixel driving circuit 302. That is, in the organic light-emitting display panel 300, at least one row of pixel driving circuits 31 include no pixel driving circuits other than the first pixel driving circuit 301 and the second pixel driving circuit 302. Accordingly, the organic light-emitting display panel 300 may not only reduce the working load of a part of the reference voltage signal lines, but further reduce the number of the light-emitting control modules. Thus, the average area occupied by each pixel driving circuit 31 may be reduced, such that the resolution may be further improved.

Figure 4:
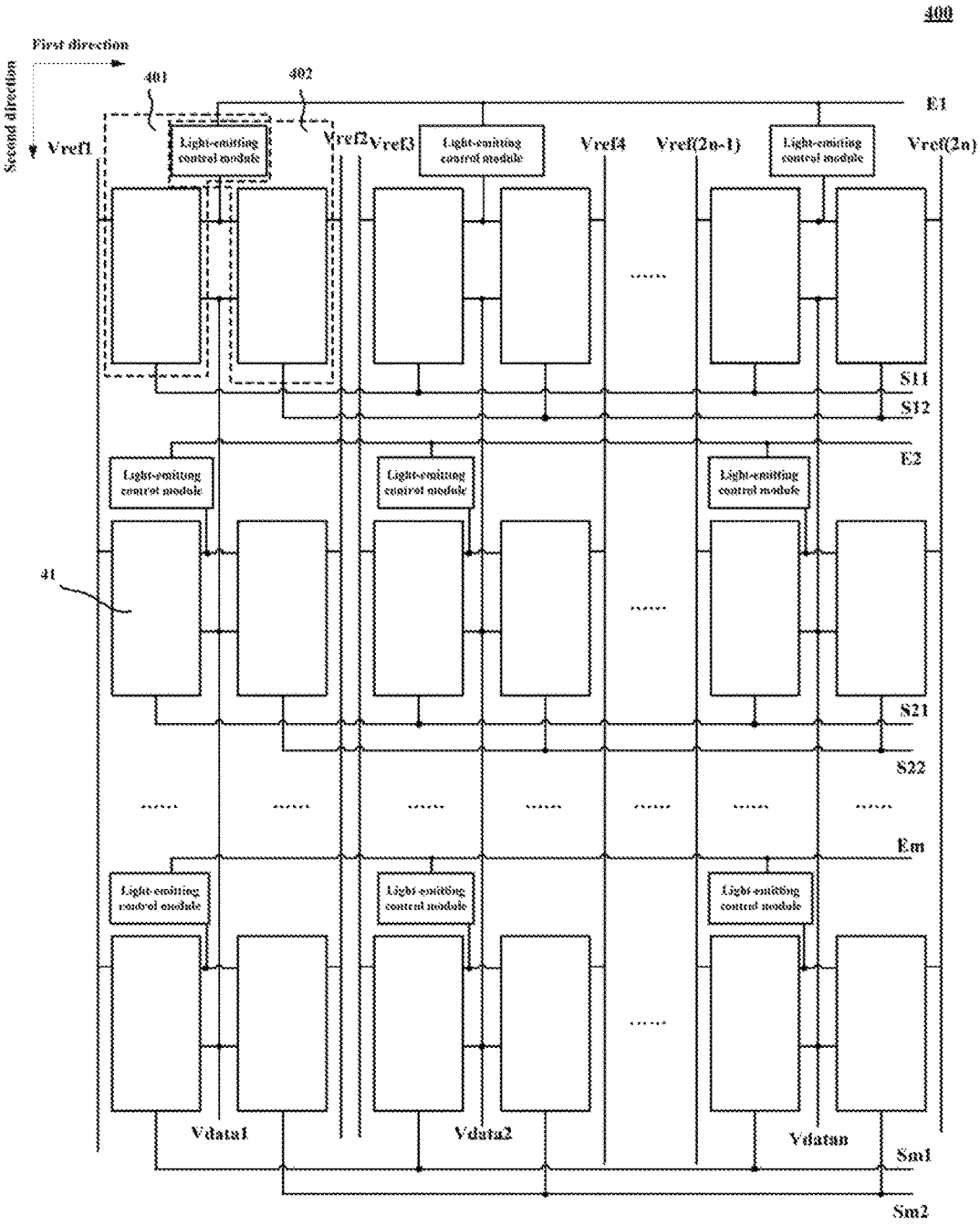
FIG. 4 illustrates a structural schematic view of another exemplary organic light-emitting display panel according to embodiments of the present disclosure.

FIG. 4 illustrates a structural schematic view of another exemplary organic light-emitting display panel 400 according to embodiments of the present disclosure. As shown in FIG. 4, the organic light-emitting display panel 400 may include a pixel matrix comprising a plurality of pixel driving circuits 41 arranged in an array, a plurality of reference voltage signal lines Vref1, Vref2, Vref3, Vref4, . . . , Vref(2n−1), Vref(2n), and a plurality of data lines Vdata1, Vdata2, . . . , Vdatan where n is a positive integer. The organic light-emitting display panel may further include a plurality of light-emitting signal lines E1, E2, . . . , Em, a plurality of first scanning signal lines S11, S12, . . . , S1*m*, and a plurality of second scanning signal lines S21, S22, . . . , S2*m*, where m is a positive integer.

In particular, each pixel driving circuit 41 may include an organic light-emitting diode, a driving transistor, and a light-emitting control module configured to charge the driving transistor. The plurality of reference voltage signal lines may be configured to provide a reference voltage signal to each pixel driving circuit 41, and each pixel driving circuit 41 may be electrically connected to one reference voltage signal line. Each pixel driving circuit 41 may be further connected to one data line, and each light-emitting control module may be electrically connected to one light-emitting signal line.

Further, the plurality of pixel driving circuits 41 may include a plurality of first pixel driving circuit 401 and a plurality of second pixel driving circuit 402. A first pixel driving circuit 401 may be electrically connected to a first scanning signal line, and a second pixel driving circuit 402 may be electrically connected to a second scanning signal line. Each first pixel driving circuit 401 and a corresponding second pixel driving circuit 402 may be connected to one data line. Further, each first pixel driving circuit 401 and a corresponding second pixel driving circuit 402 may share one light-emitting control module.

In one embodiment, in the aforementioned pixel matrix, pixel driving circuits 41 in odd-numbered columns may be first pixel driving circuits 401, and pixel driving circuits 41 in even-numbered columns may be second pixel driving circuits 402. In each row of pixel driving circuits 41, a plurality of first pixel driving circuits 401 and a plurality of second pixel driving circuits 402 may be arranged alternately. Further, first pixel driving circuits 401 in an $(i-1)^{th}$ column and second pixel driving circuits in an $i^{th}$ column may be connected to the same data line Vdata (i/2), where i is any even number greater than or equal to 2 and smaller than or equal to 2n.

In one embodiment, each data line is connected to one column of first pixel driving circuits 401 and one adjacent column of second pixel driving circuits 402 arranged along the row direction of the pixel matrix. During a period when one row of pixel driving circuits arc scanned, each data line may be configured to time-sharingly provide an initialization signal to the first pixel driving circuit 401 and the second pixel driving circuit 402 connected to the data line. Each data line may be further configured to time-sharingly detect the threshold voltages of the driving transistors in the first pixel driving circuit 401 and the second pixel driving circuit 402 connected to the data line. Further, each data line may be configured to time-sharingly provide a compensated data signal to the first pixel driving circuit 401 and the second pixel driving circuit 402 connected to the same data line.

As shown in FIG. 4, based on the organic light-emitting display panels illustrated in FIG. 1, FIG. 2, and FIG. 3, in the disclosed organic light-emitting display panel 400, each data line may detect the threshold voltages of driving transistors in two columns of pixel driving circuits 41, and provide compensated data signals to the two columns of pixel driving circuits 41. Accordingly, each reference voltage signal line in the organic light-emitting display panel may carry a constant voltage signal, and reduce the load the entire organic light-emitting display of panel. Further, the number of data lines may be further reduced, the area occupied by each pixel driving circuit may be reduced, and the resolution of the organic light-emitting display panel may be improved.

Figure 5:
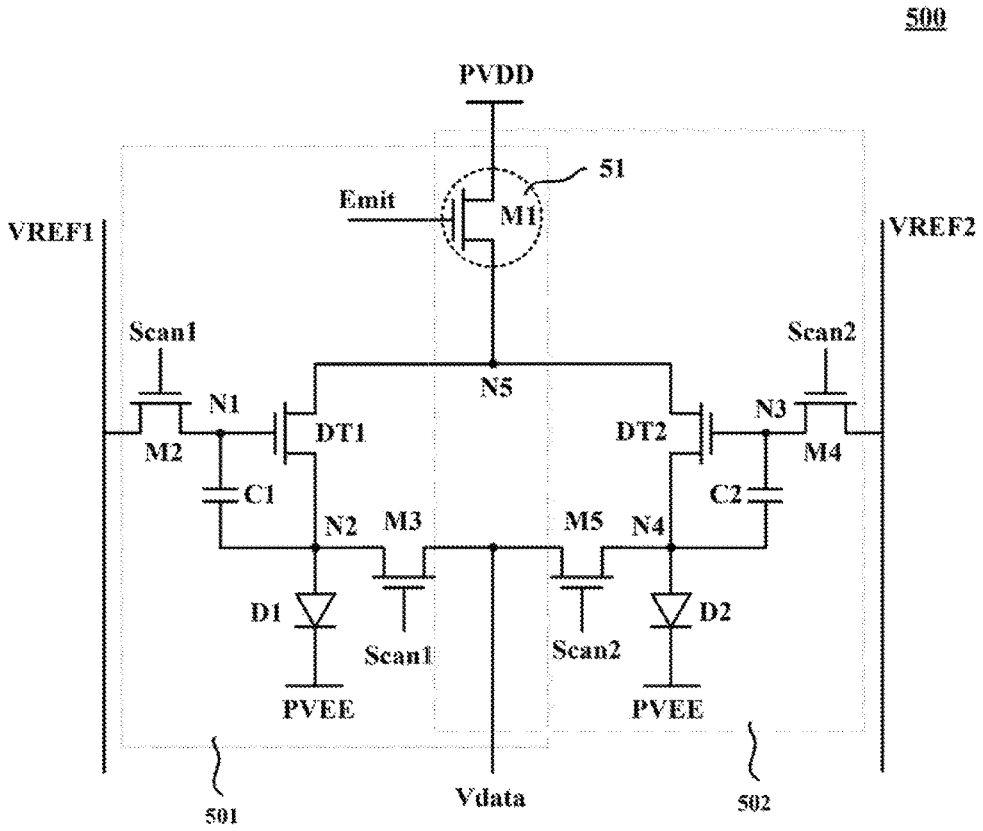
FIG. 5 illustrates a structural schematic view of a first pixel driving circuit and a second pixel driving circuit in an exemplary organic light-emitting display panel according to embodiments of the present disclosure.
Figure 9:
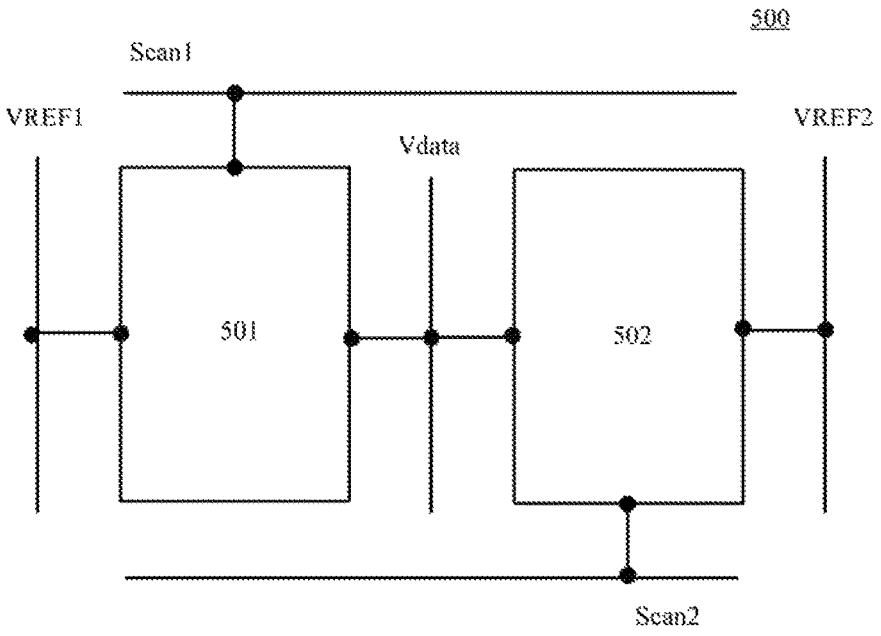
FIG. 9 illustrates a simplified circuit configuration of a first pixel driving circuit and a second pixel driving circuit in FIG. 5.

The disclosed first pixel driving circuit and the second pixel driving circuit may realize compensation of the threshold voltages of the driving transistors. FIG. 5 illustrates a structural schematic view of a first pixel driving circuit and a second pixel driving circuit in an exemplary organic light-emitting display panel 500 according to embodiments of the present disclosure. FIG. 9 illustrates a simplified circuit configuration of a first pixel driving circuit and a second pixel driving circuit shown in FIG. 5.

Referring to FIG. 5 and FIG. 9, the organic light-emitting display panel 500 may include a first pixel driving circuit 501 and a second pixel driving circuit 502. The first pixel driving circuit 501 may be connected to a first scanning signal line Scan1 and a reference voltage signal line VREF1. The second pixel driving circuit 502 may be connected to a second scanning signal line Scan2 and a reference voltage signal line VREF2.

Further, the first pixel driving circuit 501 and the second pixel driving circuit 502 may share a data signal line Vdata. Optionally, the organic light-emitting display panel 500 may further include a first voltage signal line PVDD and a second voltage signal line PVEE. The first voltage signal line PVDD may be configured to carry a first voltage signal, and the second voltage signal line PVEE may be configured to carry a second voltage signal.

More specifically, referring to FIG. 5, the first pixel driving circuit 501 and the second pixel driving circuit 502 may both include and share a light-emitting control module 51. Under control of a light-emitting signal line Emt, the light-emitting control module 51 may be configured to charge a driving transistor DT1 in the first pixel driving circuit 501 and charge a driving transistor DT2 in the second pixel driving circuit 502.

The light-emitting control module 51 may include a first transistor M1. The gate electrode of the first transistor M1 may be electrically connected to the light-emitting signal line Emit, and a first electrode of the first transistor M1 may be electrically connected to the first voltage signal line PVDD. Further, a second electrode of the first transistor M1 may be electrically connected to a node N5. The node N5 may be connected to a second electrode of the driving transistor DT1 in the first pixel driving circuit 501 and a second electrode of the driving transistor DT2 in the second pixel driving circuit 502.

The first pixel driving circuit 501 may further include an organic light-emitting diode D1, a second transistor M2, a third transistor M3, and a first capacitor C1. A first electrode of the second transistor M2 may be electrically connected to the reference voltage signal line VREF1, and a second electrode of the second transistor M2 may be electrically connected to the gate electrode of the driving transistor DT1 (node N1). A first end of the third transistor M3 may be electrically connected to the data line Vdata, and a second electrode of the third transistor M3 may be electrically connected to the first electrode of the driving transistor DT1 (node N2).

Further, the gate electrode of the second transistor M2 and the gate electrode of the third transistor M3 in the first pixel driving circuit may be each electrically connected to a first scanning signal line Scan1. Two plates of the first capacitor C1 may be electrically connected to the gate electrode of the driving transistor DT1 (node N1) and the first electrode of the driving transistor DT1 (node N2), respectively.

The coupling effect of the first capacitor C1 may ensure a constant voltage difference between the gate electrode and the first electrode of the driving transistor DT1. An anode of the organic light-emitting diode D1 may be electrically connected to the first electrode of the driving transistor DT1 (node N2), and a cathode of the organic light-emitting diode D1 may be electrically connected to the second voltage signal line PVEE.

The second pixel driving circuit 502 may further include an organic light-emitting diode D2, a second transistor M4, a third transistor M5, and a first capacitor C2. A first electrode of the second transistor M4 may be electrically connected to the reference voltage signal line VREF2, a second electrode of the second transistor M4 may be electrically connected to a gate electrode of the driving transistor DT2 (node N3). A first electrode of the third transistor M5 may be electrically connected to the data line Vdata, and a second electrode of the third transistor M5 may be electrically connected to the first electrode of the driving transistor DT2 (node N4).

Further, the gate electrode of the second transistor M4 and the gate electrode of the third transistor M5 may be each electrically connected to a second scanning signal line Scan2. Two plates of the first capacitor C2 may be electrically connected to the gate electrode (node N3) and the first electrode (node N4) of the driving transistor DT2, respectively.

The coupling effect of the first capacitor C2 may ensure a constant voltage difference between the gate electrode and the first electrode of the driving transistor DT2. An anode of the organic light-emitting diode D2 may be electrically connected to the first electrode of the driving transistor DT2 (node N4), and a cathode of the organic light-emitting diode D2 may be electrically connected to the second voltage signal line PVEE.

FIG. 5 illustrates circuit configurations of the first pixel driving circuit 501 and the second pixel driving circuit 502, and the connection relationship therebetween. Optionally, other pixel driving circuits in the disclosed organic light-emitting display panel 500 may have similar or the same structure as the first pixel driving circuit 501 or the second pixel driving circuit 502.

Optionally, the structures of the first and second pixel driving circuits illustrated in FIG. 5 may be applied to the organic light-emitting display panel 400 shown in FIG. 4. Referring to FIG. 4 and FIG. 5, in the organic light-emitting display panel 400, the gate electrodes of the second transistors M2 and the gate electrodes of the third transistors M3 in the fast pixel driving circuits 401 in the same row may be electrically connected to the same first scanning signal line S11, S12, . . . , or S1*m*. The gate electrodes of the second transistors M4 and the electrodes of the third transistors M5 in the second pixel driving circuits 402 in the same row may be electrically connected to the same second scanning signal line S21, S22, . . . , or S2*m*.

Similarly, in the organic light-emitting display panels illustrated in FIG. 1 to FIG. 3, the gate electrodes of the second transistors and the gate electrodes of the third transistors in the pixel driving circuits in the same row but not sharing the light-emitting control module may be connected to the same first scanning signal line or the same second scanning signal line. Accordingly, the number of scanning signal lines may be reduced, and the resolution of the organic light-emitting display panel may be further improved.

Figure 6:
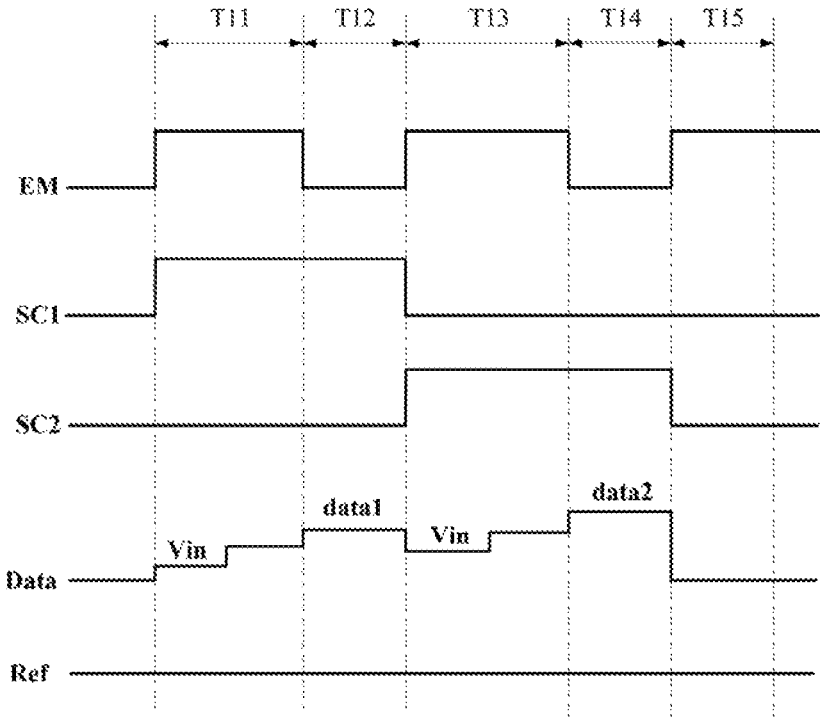
FIG. 6 illustrates an exemplary timing sequence of an organic light-emitting display panel according to embodiments of the present disclosure.
Figure 7:
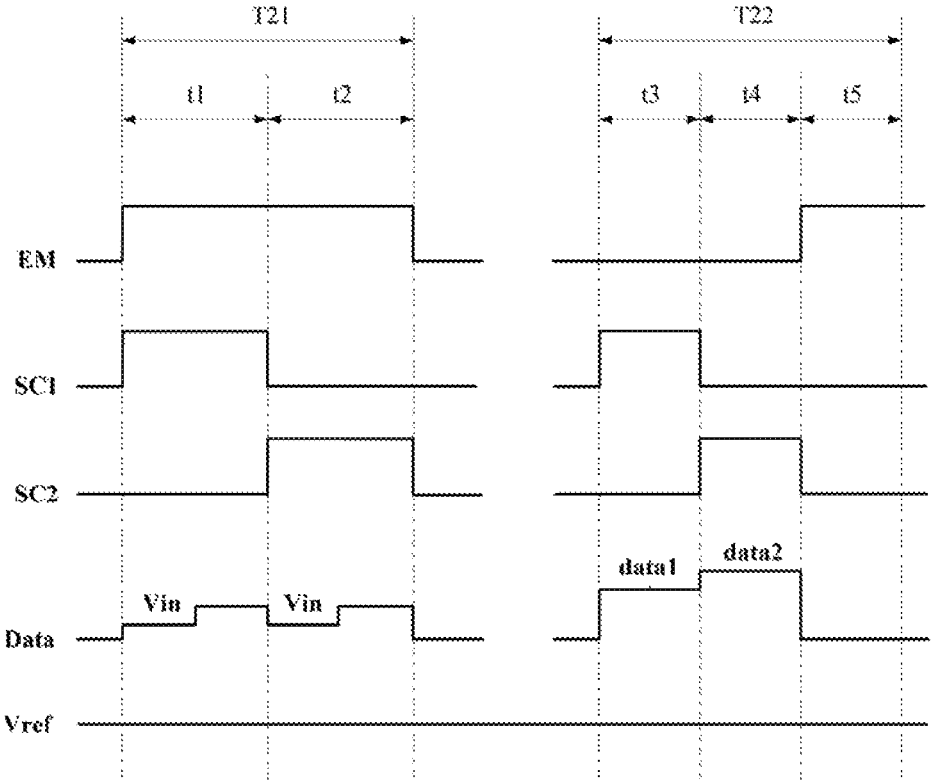
FIG. 7 illustrates another exemplary timing sequence of an organic light-emitting display panel according to embodiments of the present disclosure.

The present disclosure also provides a driving method of aforementioned organic light-emitting display panels. FIG. 6 illustrates an exemplary timing sequence of an organic light-emitting display panel according to embodiments of the present disclosure. FIG. 7 illustrates another exemplary timing sequence of an organic light-emitting display panel according to embodiments of the present disclosure.

Referring to FIG. 6 and FIG. 7, two driving methods of the organic light-emitting display panel including the first and second pixel driving circuits shown in FIG. 5 are described hereinafter in detail. For example, in the first and second pixel driving circuits illustrated in FIG. 5, the first transistor M1, the second transistors M2 and M4, the third transistors M3 and M5, and the driving transistors DT1 and DT2 may all be assumed as N-type transistors for illustrative purposes. Further, SC1, SC2, EM, Data, and Ref may represent signals provided to the first scanning signal line Scan1, the second scanning signal line Scan 2, the light-emitting signal line Emit, the data line Vdata, and the reference voltage signal line VREF, respectively.

Further, a first voltage level signal may be a high voltage signal, and a second voltage level signal may be a low voltage level signal. The high voltage level and the low voltage level may only represent relative relationships of the voltage levels, and are not restricted to specific voltage levels. For example, the high voltage level signal may be a signal that turns on the first to the third transistors, and the low voltage level signal may be a signal that turns off the first to the third transistors.

Optionally, in some other embodiments, the aforementioned transistors (M1~M5, DT1, and DT2) may all be P-type transistors, the first voltage level may be a low voltage signal, and the second voltage level may be a high voltage level. Or, optionally, the aforementioned transistors (M1~M5, DT1, and DT2) may be partially P-type transistors and partially N-type transistors, and the present disclosure is not limited thereto.

Referring to FIG. 6, a timing sequence of an organic light-emitting display panel including first and second pixel driving circuits illustrated in FIG. 5 is provided. As shown in FIG. 6, the timing sequence may sequentially include a first stage T11, a second stage T12, a third stage T13, a fourth stage T14, and a fifth stage T15 within a display period of one frame image.

The first stage T11 may be a detection stage of a threshold voltage Vth1 of the driving transistor DT1 the first pixel driving circuit 501. In the first stage T11, the first voltage level signal may be provided to the first scanning signal line Scan1 and the light-emitting signal line Emit, and the second voltage level signal may be provided to the second scanning signal line Scan2. Accordingly, the first transistor M1, the second transistor M2 and the third transistor M3 may be turned on, and the second transistor M4 and the third transistor M5 may be off.

Further, in the first stage T11, a reference voltage signal VRef may be provided to the reference voltage signal line VREF1, and a first initialization signal Vin may be provided to the data line Vdata. The difference in the voltage level between the reference voltage signal VRef and the first initialization signal Vin may be configured to be greater than the threshold voltage Vth1 of the driving transistor DT1.

Because the second transistor M2 and the third transistor M3 in the first pixel driving circuit 501 are turned on, the voltage level VN1 at the node N1 may be equal to VRef (i.e., VN1=VRef), and the voltage level VN2 at the node N2 may be equal to Vin (i.e., VN2=Vin). Accordingly, in the first stage T11, the difference in the voltage level between the node N1 and the node N2 may be greater than the threshold voltage of the driving transistor DT1, thereby turning on the driving transistor DT1.

Further, because the first transistor M1 and the driving transistor DT1 are turned on, the first voltage signal line PVDD may charge the first electrode of the driving transistor DT1 (node N2) in the first pixel driving circuit 501. When the voltage level at the node N2 is raised up to VRef−Vth1, the driving transistor DT1 may be turned off, and the first voltage signal line PVDD may stop charging.

Later, the data line Vdata may be utilized to collect the voltage level VN2 (VN2=VRef−Vth1) of the first electrode of the driving transistor DT1 (node N2) in the first pixel driving circuit 501. Thus, the threshold voltage Vth1 of the driving transistor DT1 in the first pixel driving circuit 501 may be determined. That is, because VRef is a given voltage level, the threshold voltage Vth1 of the DT1 may be calculated.

The second stage T12 may be a data signal write-in stage of the first pixel driving circuit 501. During the second stage T12, the first voltage level signal may be provided to the first scanning signal line Scan1, and a second voltage level signal may be provided to the second scanning signal line Scan 2 and the light-emitting signal line Emit. Accordingly, the second transistor M2 and the third transistor M3 may be turned on, and the first transistor M1, the second transistor M4, and the third transistor M5 may be turned off.

Further, in the second stage T12, the reference voltage signal VRef may be provided to the reference voltage signal line VREF, and the first data signal data1 after the threshold voltage Vth1 of the driving transistor DT1 in the first pixel driving circuit 501 is compensated may be provided to the data line Vdata.

Because the second transistor M2 is turned on, the reference voltage signal VRef may be transmitted to the gate electrode of the driving transistor DT1 (node N1) of the first pixel driving circuit 501. Similarly, because the third transistor M3 is turned on, the first data signal data1 may be transmitted to the first electrode of the driving transistor DT1 (node N2). By then, the voltage level at the node N1 may be VN1=VRef, and the voltage level at the node N2 may be VN2=data1.

The third stage T13 may be a detection stage of the threshold voltage Vth2 of the driving transistor DT2 in the second pixel driving circuit 502. In the third stage T13, the first voltage level signal may be provided to the second scanning signal line Scan2 and the light-emitting signal line Emit, and the second voltage level signal may be provided to the first scanning signal line Scan1. Accordingly, the first transistor M1, the second transistor M4 and the third transistor M5 may be turned on, and the second transistor M2 and the third transistor M3 may be off.

Further, in the third stage T13, the reference voltage signal VRef may be provided to the reference voltage signal line VREF2, and the first initialization signal Vin may be provided to the data line Vdata. Because the second transistor M4 in the second pixel driving circuit 502 is turned on, the voltage level at the node N3 may be equal to VRef (i.e., VN3=VRef). Because the third transistor M5 is turned on, the voltage level at the node N4 may be equal to Vin (i.e., VN4=Vin).

The difference in the voltage level between the reference voltage signal VRef and the first initialization signal Vin may be configured to be greater than the threshold voltage Vth2 of the driving transistor DT2. Accordingly, the driving transistor DT2 may be turned on.

Further, because the first transistor M1 and the driving transistor DT2 are turned on, the first voltage signal line PVDD may charge the first electrode of the driving transistor DT2 (node N4) in the second pixel driving circuit 502. When the voltage level at the node N4 (VN4) is raised to VRef−Vth2, the driving transistor DT2 may be turned off, and the first voltage signal line PVDD may stop charging.

Then, the data line Vdata may be configured to collect the voltage level VN4 (VN4=VRef−Vth2) of the first electrode of the driving transistor DT2 (node N4) in the second pixel driving circuit 502. Accordingly, the threshold voltage Vth2 of the driving transistor DT2 in the second pixel driving circuit 502 may be determined. That is, because VRef is a given voltage level, and the threshold voltage Vth2 of the driving transistor DT2 may be calculated.

The fourth stage T14 may be a data signal write-in stage of the second pixel driving circuit 502. In the fourth stage T14, the first voltage level signal may be provided to the second scanning signal line Scan2, and the second voltage level signal may be provided to the first scanning signal line Scan1 and the light-emitting signal line Emit. Accordingly, the second transistor M4 and the third transistor M5 may be turned on, and the first transistor M1, the second transistor M2, and the third transistor M3 may be turned off.

In the fourth stage T14, the reference voltage signal VRef may be provided to the reference voltage signal line VREF2 and the second data signal data2 after the threshold voltage Vth2 of the driving transistor DT2 in the second pixel driving circuit 502 is compensated may be provided to the data line Vdata.

Because the second transistor M4 is turned on, the reference voltage signal VRef may be transmitted to the gate electrode of the driving transistor DT2 (node N3) of the first pixel driving circuit 501. Because the third transistor M5 is turned on, the second data signal data2 R) may be transmitted to the first electrode of the driving transistor DT2 (node N4) in the second pixel driving circuit 502. By then, the voltage level at the node N3 may be VN3=VRef and the voltage level at the node N4 may be VN4=data2.

The fifth stage T15 may be a light-emitting stage. In the fifth stage T15, a second voltage level signal may be provided to the first scanning signal line Scan1 and the second scanning signal line Scan2, and the first voltage level signal may be provided to the light-emitting signal line Emit. The light-emitting diode D1 in the first pixel driving circuit 501 and the light-emitting diode D2 in the second pixel driving circuit 502 may emit light based on the first data signal data1 and the second data signal data2.

More specifically, the light-emitting current I1 of the light-emitting diode D1 in the first pixel driving circuit 501 and light-emitting current I2 of the light-emitting diode D2 in the second pixel driving circuit 502 may be expressed as follows:

$$I1=K1\times(VN1-VN2)^2=K1\times(V\text{Ref}-\text{data1})^2;$$

$$I2=K2\times(VN3-VN4)^2=K2\times(V\text{Ref}-\text{data2})^2.$$

Where K1 and K2 may be coefficients related to the width-to-length ratio of the driving transistor DT1 and the width-to-length ratio of the driving transistor DT2, respectively.

In the first stage T11 and the second stage T12, the second scanning signal line Scant may be configured to transmit the second voltage level signal, thereby turning off the third transistor M5 in the second pixel driving circuit 502. Accordingly, in the T11 stage or the T12 stage, the second pixel driving circuit 502 may not affect the signal carried by the data line Vdata. That is, the threshold voltage Vth1 of the driving circuit DT1 collected by the data line Vdata may not be interfered by the second pixel driving circuit 502. Further, the first data signal data1 transmitted by the data line Vdata to the first electrode of the driving transistor DT1 (node N2) may not be interfered by the second pixel driving circuit 502.

Similarly, in the third stage T13 and the fourth stage T14, the collection of the threshold voltage Vth2 of the driving transistor DT2 in the second pixel driving circuit 502 and the write-in of the second data signal data2 may not be affected by the first pixel driving circuit 501.

Optionally, the driving method may have the first stage T11, the second stage T12, the third stage T13, the fourth stage T14, and the fifth stage T15 arranged in other orders. For example, the driving method may sequentially include the second stage T12, the first stage T11, the fourth stage T14, the third stage T13, and the fifth stage T15.

Optionally, the driving method may further include a pre-stage T10 prior to the fast stage T11. In the pre-stage T10, the first voltage level signal may be provided to the second scanning signal line Scan2, and the second voltage level signal may be provided to the first scanning signal line Scan1 and the light-emitting signal line Emit. Accordingly, the second transistor M4 and the third transistor M5 in the second pixel driving circuit 502 may be turned on. The first transistor M1 may be turned off, and the second transistor M2 and the third transistor M3 may be turned off.

Further, in the pre-stage T10, the reference voltage signal VRef may be provided to the reference voltage signal line VREF2, and a data signal data0 may be provided to the data line Vdata. Because the second transistor M4 and the third transistor M5 in the second pixel driving circuit 502 are turned on, the voltage level at the node N3 may equal to VRef and the voltage level at the node N4 may equal to data0. The difference in the voltage level between VRef and data0 may be configured to turn off the driving transistor DT2 in the second pixel driving circuit 502.

Further, the driving method disclosed in FIG. 6 may utilize an external circuit to implement the compensation of the threshold voltages of the driving transistors (i.e., DT1 and DT2). Further, the working status of the reference voltage signal lines VREF1 and VREF2 in the first to the fifth stages (T11~T15) may remain unchanged. In practical applications, a constant reference voltage VRef may be provided to the reference voltage signal line VREF1 or VREF2, and the data line Vdata may be utilized to collect the threshold voltages of the first pixel driving circuit 501 and the second pixel driving circuit 502, and carry out compensation.

Accordingly, the load induced by the variance in the working status of the reference voltage signal line may be reduced. Further, because the working status of the reference voltage signal line no longer needs to be switched, the reference voltage signal line connected to each pixel driving circuit in the organic light-emitting display panel may be, connected to the same terminal of the driving chip. Thus, the number of terminals of the driving chips being occupied may be decreased, and the interface design of the driving chip may be facilitated.

FIG. 7 illustrates another exemplary timing sequence of an organic light-emitting display panel according to embodiments of the present disclosure. As shown in FIG. 7, a driving method may include a threshold detection stage T21 and a display stage T22. The threshold detection stage T21 may include a first collection stage t1 and a second collection stage t2. The display stage T22 may include a first data signal write-in stage t3, a second data signal write-in stage t4, and a light-emitting stage t5.

In the first collection stage t1 of the threshold detection stage T21, the first voltage level signal may be provided to the first scanning signal line Scan1 and the light-emitting signal line Emit, and the second voltage level signal may be provided to the second scanning signal line Scan2. The reference voltage signal VRef may be provided to the reference voltage signal line VREF1, and the first initialization signal Yin may be provided to the data line Vdata. The difference in the voltage between the reference voltage signal VRef and the first initialization signal Vin may be greater than the threshold voltage Vth1 of the driving transistor DT1.

Further, in the first collection stage t1, the first voltage signal line PVDD may charge the first electrode of the driving transistor DT1 (node N2) in the first pixel driving circa it 501. Once the voltage level at the node N2 is raised up to VN2=VRef−Vth1, the first voltage signal line PVDD may stop charging. Later, the data line Vdata may be utilized to collect the voltage level VN2 (=VRef−Vth1) of the first electrode of the driving transistor DT1 (node N2) in the first pixel driving circuit 501. Accordingly, the threshold voltage Vth1 of the driving transistor DT1 in the first pixel driving circuit may be determined. Because VRef is a given voltage level, the threshold voltage tall of the DT1 may be calculated. The calculated threshold voltage Vth1 of the driving transistor DT1 in the first pixel driving circuit 501 may be stored in a memory.

in the second collection stage t2, the first voltage level signal may be provided to the second scanning signal line Scan2 and the light-emitting signal line Emit, and the second voltage level signal may be provided to the first scanning signal line Scan 1. The reference voltage signal may be provided to the reference voltage signal line VREF2, and the first initialization signal Vin may be provided to the data line Vdata. The difference in the voltage between the reference voltage signal VRef and the first initialization signal Vin may be greater than the threshold voltage Vth2 of the driving transistor DT2.

Further, in the second collection stage t2, the first voltage signal line PVDD may charge the first electrode of the driving transistor DT2 (node N4) in the second pixel driving circuit 502. The data line Vdata may be utilized to collect the voltage level VN4(=VRef−Vth2) of the first electrode of the driving transistor DT2 (node N4) in second first pixel driving circuit 502. Accordingly, the threshold voltage Vth2 of the driving transistor DT2 in the second pixel driving circuit 502 may be determined. Because VRef is a given voltage level, the threshold voltage Vth2 may be calculated. The calculated threshold voltage Vth2 of the driving transistor DT2 in the second pixel driving circuit 502 may be stored in a memory.

Optionally, the driving method may further include a pre-stage to prior to the threshold detection stage T21, In the pre-stage t0, the first voltage level signal may be provided to the second scanning signal line Scan2, and the second voltage level signal may be provided to the first scanning signal line Scan1 and the light-emitting signal line Emit. Accordingly, the second transistor M4 and the third transistor M5 in the second pixel driving circuit 502 may be turned on. The first transistor M1 may be turned off, and the second transistor M2 and the third transistor M3 may be turned off.

Further in the pre-stage t0, the reference voltage signal VRef may be provided to the reference voltage signal line VREF2, and a data signal data0 may be provided to the data line Vdata. Because the second transistor M4 and the third transistor M5 in the second pixel driving circuit 502 are turned on, the voltage level at the node N3 may equal to VRef and the voltage level at the node N4 may equal to data0. The difference in the voltage level between VRef and data0 may be configured to turn off the driving transistor DT2 in the second pixel driving circuit 502.

In the first data signal write-in stage t3 of the display stage T22, the first voltage level signal may be provided to the first scanning signal line Scan1, and a second voltage level signal may be provided to the second scanning signal line Sean 2 and the light-emitting signal line Emit. The reference voltage signal VRef may be provided to the reference voltage signal line VREF1, and the first data signal data1 after the threshold voltage Vth1 of the driving transistor DT1 in the first pixel driving circuit 501 is compensated may be provided to the data line Vdata.

The reference voltage signal VRef may be transmitted to the gate electrode of the driving transistor DT1 (node N1) of the first pixel driving circuit 501, and the first data signal data1 may be transmitted to the first electrode of the driving transistor DT1 (node N2). By then, the voltage level at the node N1 may be VN1=VRef, and the voltage level at the node N2 may be VN2=data1.

In the second data signal write-in stage t4, the first voltage level signal may be provided to the second scanning signal line Scan2, and the second voltage level signal may be provided to the first scanning signal line Scan1 and the light-emitting signal line Emit. The reference voltage signal VRef may be provided to the reference voltage signal line VREF2, and the second data signal data2 after the threshold voltage Vth2 of the driving transistor DT2 in the second pixel driving circuit 502 is compensated may be provided to the data line Vdata.

The reference voltage signal VRef may be transmitted to the gate electrode of the driving transistor DT2 (node N3) of the first pixel driving circuit 501, and the second data signal data2 may be transmitted to the first electrode of the driving transistor DT2 (node N4) of the second pixel driving circuit 502. By then, the voltage level at the node N3 may be VN3=VRef, and the voltage level at the node N4 may be VN4=data2.

In the light-emitting stage t5, the second voltage level signal may be provided to the first scanning signal line Scan1 and the second scanning signal line Scan2, and the first voltage level signal may be provided to the light-emitting signal line Emit. The light-emitting diode D1 in the first pixel driving circuit 501 and the light-emitting diode D2 in the second pixel driving circuit 502 may emit light based on the first data signal data1 and the second data signal data2.

More specifically, the light emitting current of the light-emitting diode D1 in the first pixel driving circuit 5014 and the light-emitting current of the light-emitting diode D2 in the second pixel driving circuit 502 may be expressed as follows:

$$I1=K1\times(VN1-VN2)^2=K1\times(V\text{Ref}-\text{data1})^2,$$

$$I2=K2\times(VN3-VN4)^2=K2\times(V\text{Ref}-\text{data2})^2.$$

Where K1 and K2 may be coefficients related to the width-to-length ratio of the driving transistor DT1 and the width-to-length ratio of the driving transistor DT2, respectively.

Optionally, the driving method may further include another pre-stage t0 prior to the display stage T22 and after the threshold detection stage T21. Similarly, in the pre-stage 10 prior to the display stage T22 and after the threshold detection stage T21, the difference in the voltage level between VRef and data0 may be configured to turn of the driving transistor DT2 in the second pixel driving circuit 502.

In the first collection stage t1 and the first data signal write-in stage t3, the second scanning signal line Scan2 may be configured to carry the second voltage level signal, thereby turning off the third transistor M5 in the second pixel driving circuit 502. Accordingly, the second pixel driving circuit 502 in the T11 stage or the T12 stage may not affect the signal of the data line Vdata. That is, the threshold voltage Vth1 of the driving circuit DT1 collected by the data line Vdata may not be interfered by the second pixel driving circuit 502, and the first data signal transmitted by the data line to the first electrode of the driving transistor DT1 (node N2) may not be interfered by the second pixel driving circuit 502.

Similarly, in the second collection stage t2 and the second data signal write-in stage t4, the collection of threshold voltage Vth2 of the driving transistor DT2 in the second pixel driving circuit 502 and the write-in of the second data signal may not be affected by the first pixel driving circuit 501.

The threshold detection stage T21 may be applied to perform detection on the threshold voltage of each driving transistor in the display panel after the organic light-emitting display panel is powered on, and may store the detected threshold voltage in a manner such as a list in the memory. In the display stage T22, the threshold voltage values of the driving transistors in each pixel driving circuit may be searched in the memory, thereby determining the corresponding data signal after the threshold voltage is compensated.

Optionally, the threshold voltage may only be detected once after the power is on, and no detection on the threshold voltage may be needed when displaying each frame image. Accordingly, the driving method illustrated in FIG. 7 not only reduces the load of the reference voltage signal lines, but also reduce the number of terminals occupied by the reference voltage signal lines. Further, more time may be provided for the display stage of each frame image, thereby ensuring that the each node in the pixel driving circuits is charged to a sufficient high voltage level and the stability of the display images is improved.

On the other hand, the time needed to display each frame image may be shortened, and more display scanning of the pixel driving circuit may be completed in unit time, thereby improving the resolution of the organic light-emitting display panels.

Figure 8:
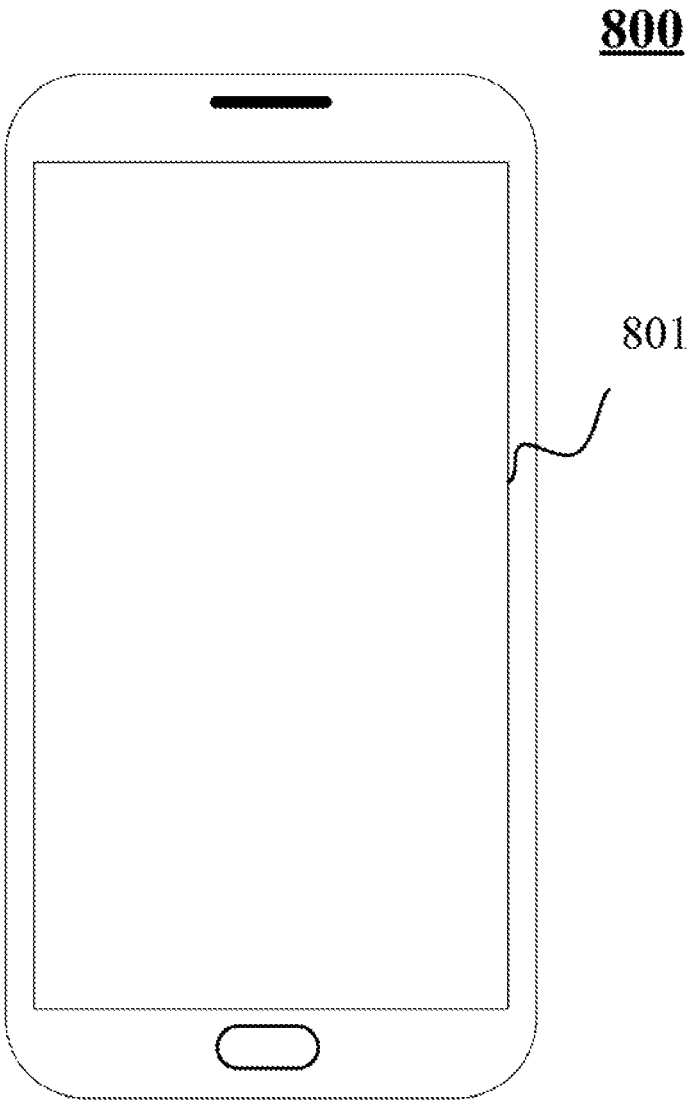
FIG. 8 illustrates a schematic view of an exemplary organic light-emitting display device according to embodiments of the present disclosure.

The present disclosure also provides an organic light-emitting display device. FIG. 8 illustrates a schematic view of an exemplary organic light-emitting display device 800 according to embodiments of the present disclosure. As shown in FIG. 8, the organic light-emitting display device 800 may include an organic light-emitting display panel 801, and the organic light-emitting display panel 801 may be any aforementioned organic light-emitting display panel. Optionally, the organic light-emitting display device 800 may further include structures such as an encapsulation film, protecting glass, etc. The organic light-emitting display device 800 may be a cell phone, a tablet, or a wearable device, etc.

It should be noted that, the above detailed descriptions illustrate only preferred embodiments of the present disclosure and technologies and principles applied herein. Those skilled in the art can understand that the present disclosure is not limited to the specific embodiments described herein, and numerous significant alterations, modifications and alternatives may be devised by those skilled in the art without departing from the scope of the present disclosure. Thus, although the present disclosure has been illustrated in above-described embodiments in details, the present disclosure is not limited to the above embodiments. Any equivalent or modification thereof, without departing from the spirit and principle of the present invention, falls within the true scope of the present invention, and the scope of the present disclosure is defined by the appended claims.

What is claimed is:

1. An organic light-emitting display panel, comprising:

a pixel matrix including a plurality of pixel driving circuits, wherein the plurality of pixel driving circuits includes a first pixel driving circuit, and a second pixel driving circuit disposed adjacent to the first pixel driving circuit along a row direction of the pixel matrix;

a plurality of reference voltage signal lines for providing a reference voltage signal; a plurality of data lines; a plurality of light-emitting signal lines; and a plurality of scanning signal lines including a first and a second scanning signal line, wherein a pixel driving circuit of the plurality of pixel driving circuits includes a driving transistor and is connected to a reference voltage signal line, a first transistor, a second transistor, a third transistor, a first capacitor, a data line, a light-emitting signal line, and a scanning signal line, the first pixel driving circuit is connected to the first scanning signal line, and the second pixel driving circuit is connected to the second scanning signal line, a gate electrode of the first transistor is connected to the light-emitting signal line, a first electrode of the second transistor is connected to the reference voltage signal line, a second electrode of the second transistor is connected to a gate electrode of the driving transistor, a first electrode of the third transistor is connected to the data line, and a second electrode of the third transistor is connected to a first electrode of the driving transistor, a gate electrode of the second transistor and a gate electrode of the third transistor are connected to a same scanning signal line, two plates of the first capacitor are connected to the gate electrode and the first electrode of the driving transistor, respectively, an anode of the organic light-emitting diode is connected to the first electrode of the driving transistor, and a cathode of the organic light-emitting diode is connected to a voltage signal line, and the first and the second pixel driving circuits share a same data line that is configured to time-sharingly provide an initialization signal to the first and the second pixel driving circuits, time-sharingly detect threshold voltages of driving transistors in the first and the second pixel driving circuits, and time-sharingly provide a compensated data signal to the first and the second pixel driving circuits, wherein the pixel driving circuit further includes the organic light-emitting diode and a light-emitting control module;

in the pixel driving circuit, the light-emitting control module is configured to charge the driving transistor, and the driving transistor is configured to supply a light-emitting current to the organic light-emitting diode: and the first pixel driving circuit and the second pixel driving circuit share a same light-emitting control module;

a first voltage signal line, wherein:

the light-emitting control module further includes the first transistor, a first electrode of the first transistor is connected to the first voltage signal line, and a second electrode of the first transistor is connected to a second electrode of the driving transistor; wherein in the same light-emitting control module shared by the first and the second pixel driving circuits, the second electrode of the first transistor is connected to a second electrode of a driving transistor in the first pixel driving circuit and a second electrode of a driving transistor in the second pixel driving circuit.

2. The organic light-emitting display panel according to claim 1, wherein:

in the first pixel driving circuit, a gate electrode of a second transistor and a gate electrode of a third transistor are connected to the first scanning signal line, and in the second pixel driving circuit, a gate electrode of a second transistor and a gate electrode of a third transistor are connected to the second scanning signal line.

3. The organic light-emitting display panel according to claim 1, wherein:

the first transistor, the second transistor, and the driving transistor are all N-type transistors.

4. The organic light-emitting display panel according to claim 1, wherein:

the plurality of pixel driving circuits includes a plurality of first pixel driving circuits and a plurality of second pixel driving circuits, the plurality of first pixel driving circuits is disposed in a same column of the pixel matrix, the plurality of second pixel driving circuits is disposed in a same column of the pixel matrix, and the first pixel driving circuits is disposed adjacent to the second pixel driving circuits along the row direction of the pixel matrix.

5. The organic light-emitting display panel according to claim 4, wherein:

in the pixel matrix, a plurality of pixel driving circuits in a same column is connected to a same data line.

6. The organic light-emitting display panel according to claim 1, wherein:

the plurality of pixel driving circuits includes a plurality of first pixel driving circuits and a plurality of second pixel driving circuits, the plurality of first pixel driving circuits and the plurality of second pixel driving circuits are disposed in a same row of the pixel matrix, and the plurality of first pixel driving circuits and the plurality of second pixel driving circuits are arranged alternately in the row direction of the pixel matrix.

7. The organic light-emitting display panel according to claim 1, wherein:

in the pixel matrix, pixel driving circuits in odd-numbered columns are first pixel driving circuits, and pixel driving circuits in even-numbered columns are second pixel driving circuits.

8. An organic light-emitting display device comprising an organic light-emitting display panel according to claim 1.

9. A driving method of an organic light-emitting display panel including a first pixel driving circuit and a second pixel driving circuit, wherein the first and the second pixel driving circuits are connected to a same data line, a same light-emitting signal line, and a same first voltage signal line, the first pixel driving circuit is connected to a first scanning signal line and a first reference voltage signal line, the second pixel driving circuit is connected to a second scanning signal line and a second reference voltage signal line, and the method comprises:

in a first stage, supplying a first voltage level signal to the first scanning signal line and the light-emitting signal line, supplying a second voltage level signal to the second scanning signal line, supplying a reference voltage signal to the first reference voltage signal line, and supplying a first initialization signal to the data line, wherein in the first pixel driving circuit, the first voltage signal line is configured to charge a first electrode of a driving transistor and the data line is configured to detect a voltage of the first electrode of the driving transistor, thereby determining a threshold voltage of the driving transistor in the first pixel driving circuit.

10. The driving method according to claim 9, further comprising:

in a second stage, supplying the first voltage level signal to the first scanning signal line, supplying the second voltage level signal to the second scanning signal line and the light-emitting signal line, supplying the reference voltage signal to the first reference voltage signal line, and supplying a first data signal after the threshold voltage of the driving transistor in the first pixel driving circuit is compensated to the data line, wherein in the first pixel driving circuit, the reference voltage signal is transmitted to a gate electrode of the driving transistor and the first data signal is transmitted to the first electrode of the driving transistor.

11. The driving method according to claim 10, further comprising:

in a third stage, supplying the first voltage level signal to the second scanning signal line and the light-emitting signal line, supplying the second voltage level signal to the first scanning signal line, supplying the reference voltage signal to the second reference voltage signal line, and supplying the first initialization signal to the data line, wherein in the second pixel driving circuit, a first voltage end is configured to charge a first electrode of a driving transistor and the data line is configured to detect a voltage of the first electrode of the driving transistor, thereby determining a threshold voltage of the driving transistor in the second pixel driving circuit.

12. The driving method according to claim 11, further comprising:

in a fourth stage, supplying the first voltage level signal to the second scanning signal line, supplying the second voltage level signal to the first scanning signal line and the light-emitting signal line, supplying the reference voltage signal to the second reference voltage signal line, and supplying a second data signal after the threshold voltage of the driving transistor in the second pixel driving circuit is compensated to the data line, wherein in the second pixel driving circuit, the reference voltage signal is transmitted to a gate electrode of the driving transistor, and the second data signal is transmitted to the first electrode of the driving transistor, and in a fifth stage, supplying the first voltage level signal to the first and the second scanning signal lines, and supplying the second voltage level signal to the light-emitting signal line, such that a light-emitting element in the first pixel driving circuit and a light-emitting element in the second pixel driving circuit emit light based on the first data signal and the second data signal.

13. A driving method of an organic light-emitting display panel including a first pixel driving circuit and a second pixel driving circuit, wherein the first and the second pixel driving circuits are connected to a same data line, a same light-emitting signal line, and a same first voltage signal line, the first pixel driving circuit is connected to a first scanning signal line and a first reference voltage signal line, the second pixel driving circuit is connected to a second scanning signal line and a second reference voltage signal line, and the method comprises:

in a first collection stage, supplying a first voltage level signal to the first scanning signal line and the light-emitting signal line, supplying a second voltage level signal to the second scanning signal line, supplying a first initialization signal to the data line, and supplying a reference voltage signal to the first reference voltage signal line, wherein in the first pixel driving circuit, the first voltage signal line is configured to charge a first electrode of a driving transistor and the data line is configured to collect a voltage of the first electrode of the driving transistor, thereby determining and storing a threshold voltage of the driving transistor in the first pixel driving circuit.

14. The driving method according to claim 13, further comprising:

in a second collection stage, supplying the first voltage level signal to the second scanning signal line and the light-emitting signal line, supplying the second voltage level signal to the first scanning signal line, supplying the first initialization signal to the data line, and supplying the reference voltage signal to the second reference voltage signal line, wherein in the second pixel driving circuit, the first voltage signal line is configured to charge a first electrode of a driving transistor and the data line is configured to collect a voltage of the first electrode of the driving transistor, thereby determining and storing a threshold voltage of the driving transistor in the second pixel driving circuit.

15. The driving method according to claim 13, further comprising:

in a first data signal write-in stage, supplying the first voltage level signal to the first scanning signal line, supplying the second voltage level signal to the second scanning signal line and the light-emitting signal line, supplying the reference voltage signal to the first reference voltage signal line, and supplying a first data signal after the threshold voltage of the driving transistor in the first pixel driving circuit is compensated to the data line, such that in the first pixel driving circuit, the reference voltage signal is transmitted to a gate electrode of the driving transistor and the first data signal is transmitted to the first electrode of the driving transistor, and in a second data signal write-in stage, supplying the first voltage level signal to the second scanning signal line, supplying the second voltage level signal to the first scanning signal line and the light-emitting signal line, supplying the reference voltage signal to the second reference voltage signal line, and supplying a second data signal after a threshold voltage of the driving transistor in the second pixel driving circuit is compensated to the data line, such that in the second pixel driving circuit, the reference voltage signal is transmitted to a gate electrode of the driving transistor and the second data signal is transmitted to the first electrode of the driving transistor.

16. The driving method according to claim 14, further comprising:

in a light-emitting stage, supplying the first voltage level to the first and the second scanning signal lines, and supplying the second voltage level signal to the light-emitting signal line, such that the light-emitting elements in the first and the second pixel driving circuits emit light based on the first data signal and the second data signal.

* * * * *